United States Patent [19]

Pearson

[11] 4,393,909

[45] Jul. 19, 1983

[54] UNIVERSAL ADMINISTRATION PORT

[75] Inventor: Stephen Pearson, Ingleside, Ill.

[73] Assignee: Baxter Travenol Laboratories, Inc., Deerfield, Ill.

[21] Appl. No.: 335,132

[22] Filed: Dec. 28, 1981

[51] Int. Cl.[3] ..... B65D 41/20

[52] U.S. Cl. ..... 150/8; 141/330; 215/250

[58] Field of Search ..... 150/8; 141/330, 329; 215/250; 222/81, 83, 541

[56] References Cited

U.S. PATENT DOCUMENTS

| | | | |
|---|---|---|---|
| 3,106,206 | 10/1963 | Barr et al. | 128/276 |
| 3,831,814 | 8/1974 | Butler | 222/81 |
| 3,938,520 | 2/1976 | Scislowicz et al. | 141/330 X |
| 4,022,258 | 5/1977 | Steidley | 141/330 |
| 4,046,276 | 9/1977 | Winchell et al. | 150/8 |
| 4,173,858 | 11/1979 | Cassia | 141/330 X |
| 4,177,906 | 12/1979 | Von Hagel | 215/252 |

*Primary Examiner*—Donald F. Norton

*Attorney, Agent, or Firm*—Paul C. Flattery; John P. Kirby, Jr.; Bradford R. L. Price

[57] ABSTRACT

An administration port (14) for medical fluid containers (10) is provided which creates a proper seal with a broad dimensional range of cannulas. The port includes an inwardly tapered end 28 which can flex outwardly during insertion of a cannula (16). The inwardly tapered end 28 works in conjunction with an inner surface (32) of the sidewall (18) and end (28) to provide a unique sealing construction, to minimize friction between the port (14) and the cannula (16) during insertion of the cannula (16) and to inhibit inadvertent removal of the cannula. Selective removal of the associated cannula requires relatively little force, however.

8 Claims, 6 Drawing Figures

UNIVERSAL ADMINISTRATION PORT

DESCRIPTION

Technical Field of the Invention

The present invention relates to an administration port for a fluid container and in particular relates to an administration port for a medical fluid container, used in conjunction with an associated cannula of a medical fluid administration set.

BACKGROUND OF THE INVENTION

Some medical fluids are delivered intravenously to a patient. These fluids may be delivered through an administration set having at one end a spike or cannula which is inserted into the container for the medical fluid at an administration port on the container. In such a system, fluid communication between the container and the administration set is often established by piercing a membrane within the administration port, with the cannula. The interface between the administration port and the cannula is extremely important. A good seal must be established between the cannula and the administration port so as to prevent contamination of the medical fluid, which may be blood, dextrose or saline solution or one of myriad other medical fluids. Contamination may endanger the health of the patient.

However, the administration port must be designed so as to permit insertion of the cannula into the administration port and through the pierceable membrane by medical personnel without the aid of additional equipment and without requiring a significant amount of time.

To achieve the appropriate seal without undue application of force generally requires the use of a spike having dimensions which are within precise parameters, i.e., the administration port is meant to be used with a cannula of a particular size. Further, there is usually an extremely high inverse relationship between spiking resistance during insertion of the cannula and the chances of accidental removal of the cannula during use, such as may be caused by movement of the patient. In order to provide a seal which is not prone to inadvertent removal of the cannula, the interference fit between the cannula and port is typically such that insertion of the cannula requires a significant application of force.

SUMMARY OF THE INVENTION

The present invention is directed to a universal administration port; that is, one which may be used with different cannulas having a relatively broad range in size, particularly with respect to the diameters of the cannulas. The administration port of the present invention greatly reduces friction during insertion of the cannula into the administration port, thus facilitating an easy connection between the administration set and the container in a short period of time by medical personnel without an unusually high applied force. This reduction of friction permits the use of a thicker membrane than would otherwise be possible. A thicker membrane requires more force to pierce but the designed, reduced friction between the cannula and the administration port permits use of such a thicker membrane. A thicker membrane is easier to mold and is less expensive to manufacture. The thicker membrane also provides a good barrier between the container and the environment.

While providing for easy puncture, the administration port of the present invention is highly resistant to inadvertent cannula withdrawal, yet provides for relatively easy selective removal of the cannula.

DETAILED DESCRIPTION OF THE PREFERRED EMBODIMENT

Figure 1:
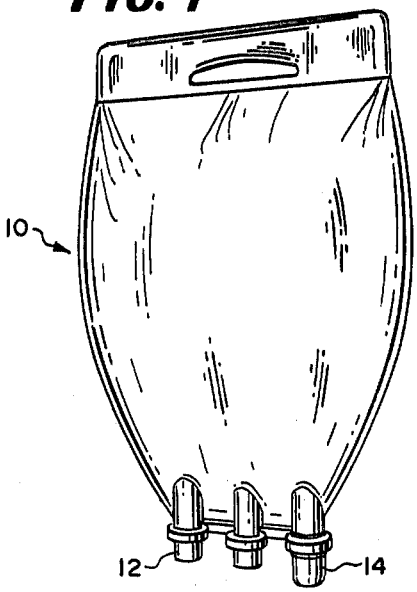
FIG. 1 is a perspective view of a medical fluid container having the reduced friction administration port of the present invention.

In FIG. 1 there is illustrated a medical fluid container 10 of flexible plastic suitable for storing a medical fluid, such as a dextrose solution. The container need not be flexible and may be constructed of glass. The container 10 includes an injection site 12 and the administration port 14 of the present invention.

Figure 2:
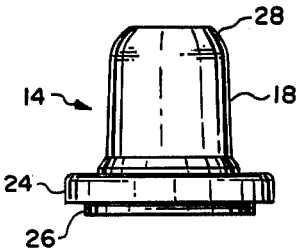
FIG. 2 is a side view of the administration port.
Figure 3:
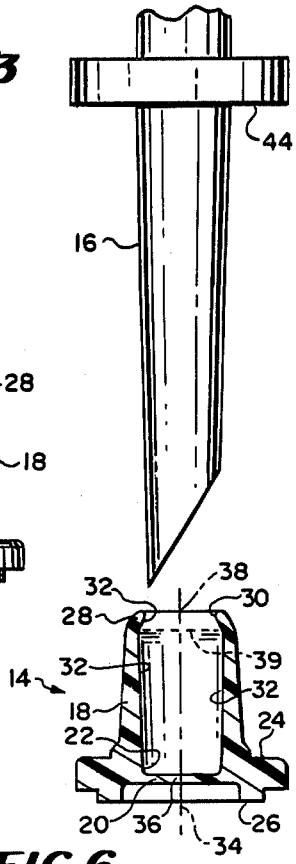
FIG. 3 is a cross-sectional view of the administration port with an administration set cannula spaced therefrom.

FIG. 2 is a side view of the administration port 14, which may be manufactured separately as shown and subsequently attached to the container 10.

Referring now to FIGS. 3 through 6 there is shown the administration port 14 of the present invention and its interaction with an associated cannula 16 that is connected to a medical fluid administration set (not shown), for delivery of the medical fluid to a patient. The associated cannula 16 is not part of the present invention. The administration port 14 includes a sidewall 18. A cannula-pierceable membrane 20 is disposed at the base 22 of the sidewall 18. The administration port 14 may include an outwardly extending rim 24 and connecting ring 26 to facilitate attaching the administration port 14 to the container 10 by means of, for example, an adhesive or radio frequency seal.

An inwardly tapered end 28 is continuous with the sidewall 18 and opposite the base 22 of the sidewall and the membrane 20. The inwardly tapered end 28 defines a circular opening 30 to the volume defined by the inner surface 32 of the sidewall 18 and the inwardly tapered end 28.

Although not believed necessary to the operation of the invention, it has been found that the administration port 14 may be inexpensively made by an injection molding process. The material should be flexible enough so as to permit withdrawal of that portion of the mold within the defined volume during manufacture, as limited by the inwardly tapered end 28. Additionally, the administration port 14 must have an adequate memory. However, the port 14 must be flexible enough to permit its operation as defined below. Because of these requirements, it has been found that the administration port is preferably made of a semi-rigid plastic material, such as polypropylene. Other plastics can be employed. For example, it is believed that a plastic material having a polyvinyl chloride base will also function adequately.

The inner surface 32 of the administration port 14 is substantially concentric about a longitudinal axis such as shown by phantom line 34 which is taken through the membrane center 36 and through the center point 38 of the circular opening 30 defined by the inwardly tapered end 28.

The diameter measurement taken across the defined volume, thereby spanning the inner surface, increases along the longitudinal axis. Stated differently, the diameter measurement increases from the base 22 of the sidewall 18 substantially up to the inwardly tapered end 28. The diameter measurement at the junction of the sidewall 18 and the tapered end 28 is shown by a phantom line 39. Proceeding in the same direction, the diameter measurement decreases from the commencement of the inwardly tapered end 28 up to the end-defined circular opening 30. Further, the diameter measurement at the circular opening 30 is less than or equal to the diameter measurement at the membrane 20.

For illustrative purposes and as an example only, the following dimensions describe an administration port 14 which embodies the present invention. The height of the administration port from the bottom 40 of the connecting ring 26 to the top 42 of the port 14 is about 0.51 in. The height of the defined volume is about 0.43 in. The height of the sidewall from the base 22 to the inwardly tapered end 28 is about 0.36 in. The height of the inwardly tapered end 28 is about 0.07 in. The diameter of the volume at the base 22 of the sidewall 18 is about 0.21 in. The diameter of the volume at the interface between the sidewall 18 and inwardly tapered end 28 is about 0.23 in. The diameter of the circular opening 30 is about 0.18 in. The membrane is about 0.02 in. thick.

It must be remembered that for medical applications, virtual sterility is required. Therefore, a cap of some sort (not shown) such as, for example, a removable membrane sealed to the inwardly tapered end 28 may be used to close the circular opening 30. The cap is removed before use.

Turning now to the operation of the administration port 14, an associated cannula 16 is inserted through the circular opening 30. Most cannulas on commercially sold, medical fluid administration sets are fairly straight walled, with perhaps a roughly three degree taper serving as a draft for molding. One of the key features of the present invention is that the administration port 14 may be used with a broad range of cannula sizes. The port 14 need not be employed with a specific cannula. Thus, for purposes of this disclosure, the associated cannula 16 refers to any of a number of cannulas which fit within the rather broad dimensional range permitted by the administration port 14 of the invention.

Figure 4:
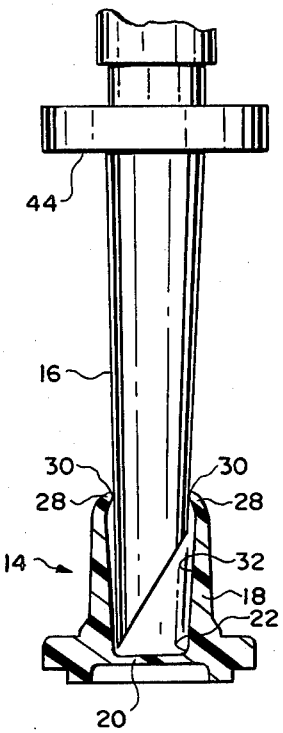
FIG. 4 is a cross-sectional view of the administration port with the spike just above the membrane.

As seen best in FIG. 4, until the cannula 16 reaches the membrane 20 its only contact with the administration port will be at the circular opening 30 defined by the inwardly tapered end 28. If a larger cannula is used, it is possible that it may contact a portion of the sidewall 18 near the base 22 before the cannula reaches the membrane 20.

Although little if any surface contact between the inner surface 32 and the cannula 16 may occur before the membrane 20 is pierced, an adequate seal is formed between the cannula 16 and the inwardly tapered end 28 at the circular opening 30 prior to destroying the contaminant barrier, such as the membrane 20.

Figure 5:
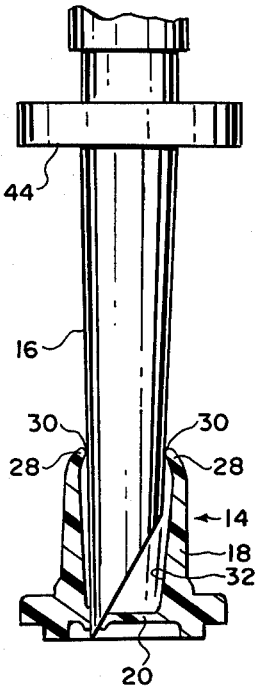
FIG. 5 is a cross-sectional view of the administration port with the cannula breaking the membrane.
Figure 6:
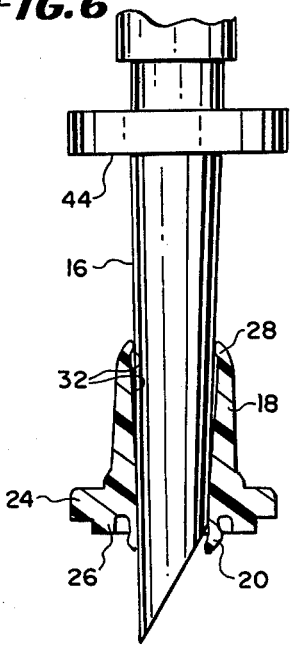
FIG. 6 is a cross-sectional view of the port with the cannula fully mounted therein.

As seen in FIG. 5, continued insertion of the associated cannula 16 pierces the membrane 20. As the cannula 15 is inserted it may force the inwardly tapered end 28 to flex outwardly, thereby increasing the diameter of the circular opening 30. Such action with reduce the degree of inward taper and somewhat lengthen the administration port 14. As seen in FIGS. 4 and 5, the only contact between the inner surface 32 and the associated cannula 16 up to and during the piercing of the membrane 20 may be at the circular opening 30, thereby facilitating the use of less force in piercing the membrane 20 than would otherwise be possible if the cannula 16 engaged the sidewall 18 along substantially its entire length.

After the membrane 20 is pierced the associated cannula is typically inserted further until limited by either the diameter of the administration port 14 or a stop 44 on the associated cannula 16. During complete insertion of the cannula an interference fit is finally achieved between the cannula 16 and at least a significant part of the inner surface 32 so as to provide a microbial barrier between the inner surface 32 and the cannula 16, preventing the communication of container-external contaminants to the container 10 therebetween.

In the preferred embodiment, the inner surface 32, particularly along the inwardly tapered portion 28, bears down against the associated cannula 16 upon the application of force to the cannula in a direction away from the administration port 14. This greatly inhibits the inadvertent removal of the cannula 16 from the administration port 14. However, selective removal of the cannula is quite easy if the cannula or the container 10 with the administration port 14 thereon is slightly rotated during removal of the cannula 16.

The design of the administration port 14 permits a great degree of flexure of the inwardly tapered portion 28, thus providing for compatability with a wide range of cannula diameters. For instance, although not tested, it is believed that the specifically dimensioned administration port discussed above would be compatible with cannulas having port-contacting diameters anywhere from 0.190 in to 0.225 in., thereby providing medical personnel with greater flexibility in the use of fluid containers and different administration sets, lessening or eliminating the problem of incompatibility which may exist between products made by different companies. The administration port 14 of the present invention is also helpful in alleviating the typically accentuated problem of incompatibility which may otherwise necessitate product design changes when, for example, a solution container designed for use in one country is sold for possible use with a cannula-incorporating administration set designed for use in another country.

While one embodiment of the present invention has been described in detail and shown in the accompanying drawings, and other embodiments have also been suggested, it will be evident that various further modifications are possible without departing from the scope of the invention.

What is claimed is:

1. A fluid container administration port for use with an associated cannula, comprising:

(a) a continuous sidewall;

(b) a cannula-pierceable membrane extending across a base of said sidewall;

(c) an inwardly tapered end continuous with said sidewall and opposite said base and said membrane;

(d) a volume-defining inner surface of said sidewall and said inwardly tapered end;

(e) said inner surface being substantially concentric about a longitudinal axis of said port taken through the center of said membrane and the center of a circular opening defined by said inwardly tapered end;

(f) such that diameter measurements, taken across said defined volume so as to span said inner surface, increase along said longitudinal axis from said membrane substantially up to said inwardly tapered end and decrease along said longitudinal axis from the commencement of said inwardly tapered end up to said end-defined circular opening;

(g) said diameter measurement at said circular opening being not greater than said diameter measurement at said membrane;

(h) wherein said diameter measurements are such that upon insertion of an associated cannula, that portion of said inner surface at said circular opening provides a circumferential seal about the associated cannula before the cannula pierces said membrane.

2. The fluid container administration port as in claim 1, wherein said port is made of an injection-moldable plastic.

3. The fluid container administration port as in claim 1, wherein said diameter measurements are such that upon insertion of an associated cannula only that portion of said inner surface at said circular opening provides a circumferential seal about the associated cannula before the cannula pierces said membrane.

4. The fluid container administration port as in claims 1 or 3, wherein said inwardly tapered end is constructed so as to permit its outward flexure during insertion of an associated cannula.

5. The fluid container administration port as in claim 4, wherein after said membrane is pierced a significant part of said inner surface is in contact with the associated cannula so as to provide a microbial barrier between the cannula and said inner surface and so as to inhibit inadvertent withdrawal of the cannula.

6. The fluid container administration port as in claim 5, wherein said port permits selective withdrawal of the associated cannula with relatively little force upon the concurrent application of a twisting force to the cannula.

7. The fluid container administration port as in claim 1, wherein the diameter of said end-defined circular opening is about 0.18 inch.

8. The fluid container administration port as in claim 1, such that after the associated cannula has been completely inserted in said administration port, upon subsequent pulling of the cannula away from said administration port, said inner surface and said inwardly tapered portion bear down against the associated cannula, thereby inhibiting removal of the cannula from said port.

* * * * *